United States Patent [19]

Yakuwa

[11] Patent Number: 4,656,989

[45] Date of Patent: Apr. 14, 1987

[54] SYSTEM FOR DRIVING SOLENOID VALVE FOR INTERNAL COMBUSTION ENGINE

[75] Inventor: Masahiko Yakuwa, Fujimi, Japan

[73] Assignee: Honda Giken Kogyo Kabushiki Kaisha, Tokyo, Japan

[21] Appl. No.: 846,686

[22] Filed: Apr. 1, 1986

[30] Foreign Application Priority Data

May 13, 1985 [JP] Japan ..... 60-99651

[51] Int. Cl.[4] ..... F02M 51/00

[52] U.S. Cl. ..... 123/490; 361/154

[58] Field of Search ..... 123/490; 361/154, 194, 361/152

[56] References Cited

U.S. PATENT DOCUMENTS

| | | | |
|---|---|---|---|
| 3,579,052 | 5/1971 | Kato | 317/148.5 |
| 4,134,367 | 1/1979 | Ferry et al. | 123/490 |
| 4,234,903 | 11/1980 | Harper | 123/490 |
| 4,452,210 | 6/1984 | Sasayama et al. | 123/490 |
| 4,511,945 | 4/1985 | Nielsen | 123/490 |
| 4,604,675 | 8/1986 | Pflederer | 123/490 |
| 4,605,983 | 8/1986 | Harvey | 123/490 |
| 4,607,311 | 8/1986 | Brown et al. | 123/490 |

*Primary Examiner*—Raymond A. Nelli
*Attorney, Agent, or Firm*—Armstrong, Nikaido, Marmelstein & Kubovcik

[57] ABSTRACT

The present invention is directed to a system for driving a solenoid valve for an internal combustion engine in which the period of a solenoid valve holding pulse signal is preset, and even if an output time of an injector ON control signal changes in response to some particular engine operating conditions, the end of the output time of the injector ON control signal and that of a solenoid valve holding pulse signal are rendered completely coincident with each other. Therefore, the solenoid valve can be controlled accurately at a predetermined injector ON time, thus permitting an appropriate fuel injection. A solenoid valve holding time which is shorter than a difference obtained by subtracting the shortest time Tomin required for lifting a solenoid valve from a predetermined output time Ti of the injector ON control signal and which is an integer (N) multiple of a period T of a solenoid valve holding pulse, and an actual solenoid valve lifting time Tone is obtained from the difference between the Ti and the solenoid valve holding time.

10 Claims, 7 Drawing Figures

Ti

Tomin
T
T
T
T
T
Tr

Tone

Ti
Tomin
Tkeep

T

Ti

Tr

Tone = f1 (VB) + Tr
ON
OFF

TOFF (CONST.)
T = f2 (VB)
OFF
ON

N COUNTER
7 6 5 4 3 2 1
6 5 4 3 2 1 0
ON
OFF
ON

Imax
Iave

SYSTEM FOR DRIVING SOLENOID VALVE FOR INTERNAL COMBUSTION ENGINE

BACKGROUND OF THE INVENTION

1. Field of the Invention

The present invention relates to a system for driving a solenoid valve for an internal combustion engine. Particularly, it is directed to a system for driving a solenoid valve for an internal combustion engine which system controls a drive circuit for a fuel injecting solenoid valve with a pulse signal.

2. Description of the Prior Art

Heretofore, systems which control a drive circuit for a solenoid valve for an internal combustion engine with a DC signal have generally been well known. However, these conventional systems have the disadvantage in that the loss of power is increased.

In view of the above, systems have been proposed which control a drive circuit for a solenoid valve for an internal combustion engine with a pulse signal as shown, for example, in Japanese Patent Laid-Open Publication No. 203830/82. This system is advantageous in that the consumption of power can be reduced in comparison with the above conventional system which employs a DC signal for controlling the drive circuit.

The amount of fuel injected depends on the duration (hereinafter referred to as "injector ON time") of the opening of the solenoid valve since the opening degree of the solenoid valve and the fuel pressure are constant. It is also generally well known that the injector ON time varies according to the operating conditions of an engine. For example, at the time of acceleration it is necessary to make the injector ON time relatively large.

The operating state of the engine is determined on the basis of, for example, engine speed, pressure (intake manifold pressure) in the intake manifold, engine coolant temperature (engine temperature) and atmospheric pressure.

In the drive control system using a pulse signal, as shown in FIGS. 5(*a*) and 5(*b*), the injector ON time and hence an output time Ti of an injector ON control signal fed to a drive circuit, which determines the injector ON time, is divided into a shortest time Tomin required for lifting a solenoid valve and a holding time Thold for holding the solenoid valve in a lifted state.

More specifically, the shortest time Tomin required for lifting the solenoid valve is a single pulse width time, while the solenoid valve holding time Thold is the total time of plural pulse signals whose period T is determined by a monostable multivibrator for example.

A solenoid valve holding current is predetermined according to the characteristics of the solenoid valve. Therefore, the duty ratio of a pulse signal of the holding time Thold fed to a solenoid valve driving circuit is also determined in advance.

The above conventional techniques involve the following problems.

As previously noted, the output time Ti of the injector ON control signal is determined according to an operating state of the engine, and the shortest time Tomin required for lifting the solenoid valve at the output time Ti of the injector ON control signal is predetermined according to characteristics of the solenoid valve.

Therefore, the solenoid valve holding time Thold is determined as a time corresponding to a difference obtained by subtracting the shortest time Tomin required for lifting the solenoid valve from the output time Ti of the injector ON time control signal.

However, as previously noted, where the period of pulse signal at the solenoid valve holding time Thold is decided in advance, if the output time Ti of the injector 0N control signal becomes shorter or longer as indicated at T'i, than the time Ti shown in FIG. 5(*a*), as shown in FIG. 5(*d*), the solenoid valve holding pulse signals in the solenoid valve holding time are not an integer multiple of a certain period and this results in a remainder time Tr [see FIGS. 5(*e*)].

As a result, the waveform of the solenoid valve holding circuit signal assumes the state of FIG. 5(*f*) relative to the state (c) of the injector ON control signal (b). That is, the solenoid valve holding current value, upon the lapse of the output time of the injector ON signal, differs depending on whether the remainder time Tr is present or not. Consequently, according to the conventional drive control system using a pulse signal, there arises a difference in the duration from after the lapse of the output time of the injector ON control signal until the solenoid valve actually assumes a closed state. Thus, the injector 0N time of the solenoid cannot be properly controlled.

SUMMARY OF THE INvENTION

It is the primary object of the present invention to provide a system for driving a solenoid valve for an internal combustion engine in which the period of a solenoid valve holding pulse signal is preset, and even if an output time of an injector ON control signal changes in response to some particular engine operating conditions, the end of the output time of the injector ON control signal and that of a solenoid valve holding pulse signal are rendered completely coincident with each other. Therefore, the solenoid valve can be controlled accurately at a predetermined injector 0N time, thus permitting an appropriate fuel injection.

A solenoid valve holding time which is shorter than a difference obtained by subtracting the shortest time Tomin required for lifting a solenoid valve from a predetermined output time Ti of the injector ON control signal and which is an integer (N) multiple of a period T of a solenoid valve holding pulse, and an actual solenoid valve lifting time Tone is obtained from the difference between the Ti and the solenoid valve holding time.

DETAILED DESCRIPTION OF THE PREFERRED EMBODIMENT

The present invention will be described in detail hereinunder with reference to the drawings.

Figure 2:
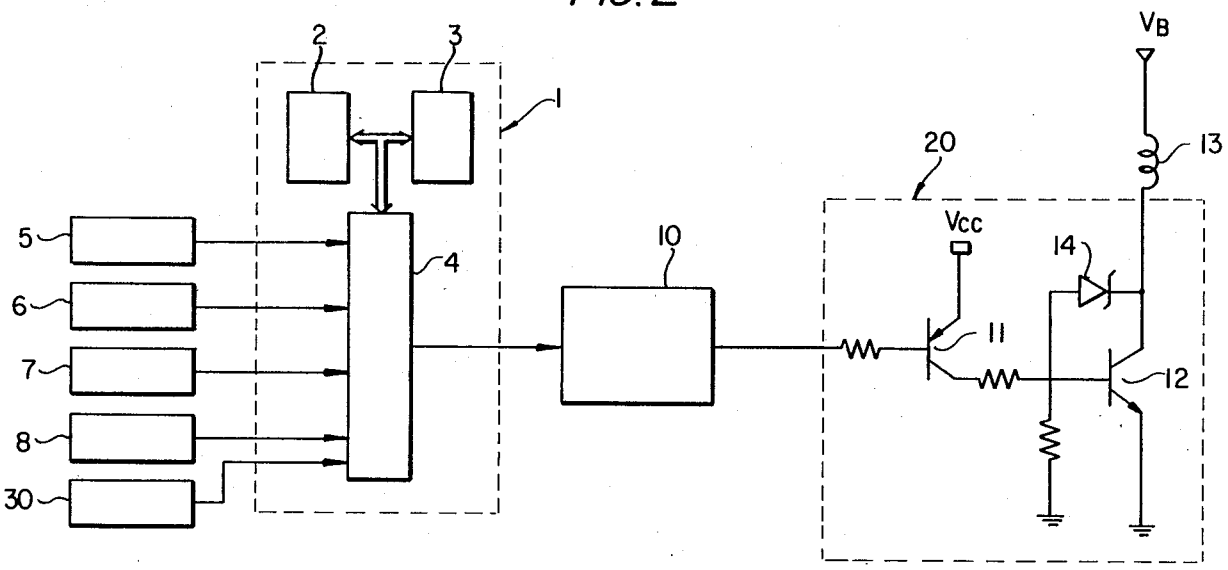
FIG. 2 is a schematic diagram of the preferred embodiment of the present invention.

FIG. 2 is a schematic block diagram of the preferred embodiment of the present invention, in which a microcomputer 1 comprises a central processing unit (CPU) 2, a memory 3, and an input/output signal circuit (interface) 4. In the microcomputer 1, the operating conditions of an engine are detected as input signals received from an engine speed (Ne) sensor 5, an intake-manifold pressure (Pba) sensor 6, an engine temperature (Tw) sensor 7, and an atmospheric pressure (Pa) sensor 8. An output time Ti of an injector ON control signal is calculated in response thereto.

Moreover, a battery voltage sensor 30 detects the voltage vb of a battery which supplies electric current to a solenoid 13 of a solenoid valve for an internal combustion engine, and applies the output thereof to microcomputer 1 which determines a shortest time Tomin required for lifting the solenoid valve and a period T of a solenoid valve holding pulse, in response thereto, as will be described later.

The microcomputer 1 calculates an actual solenoid valve lifting time Tone and the number N of solenoid valve holding pulses of the period T in the output time Ti of the injector ON control signal. The microcomputer 1 then outputs signals of Tone, T and N to a timer LSI 10 from the interface 4.

Figures 4A, 4B, 4C:
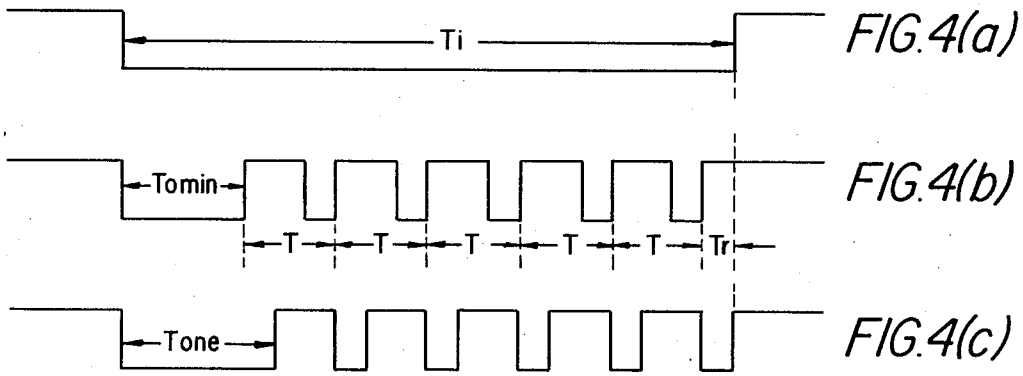
FIG. 4 is a time chart for explaining the operation of the embodiment illustrated in FIG. 3.
Figures 5A, 5B, 5C, 5D, 5E, 5F:
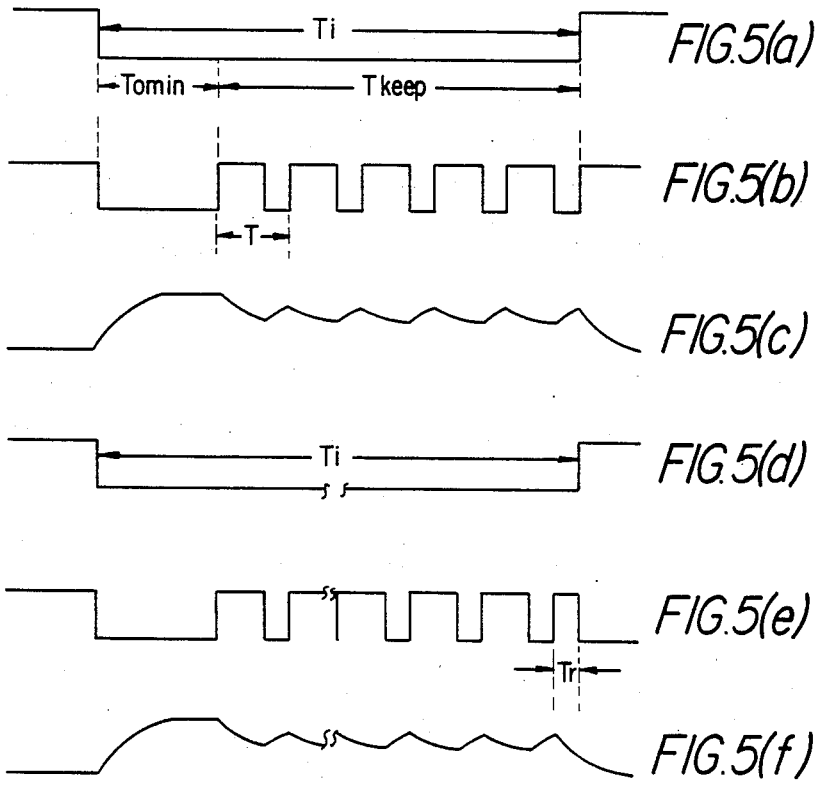
FIG. 5 is a time chart for explaining the operation of a conventional system for driving a solenoid valve for an internal combustion engine.

The timer LSI 10 produces a low level signal (L signal) during the solenoid valve lifting time Tone, and upon lapse of the Tone it produces a solenoid valve holding pulse signal of a certain period, as shown in FIG. 4(*c*), by a suitable known method.

The output [see FIG. 4(*c*)] of the timer LSI 10 which varies pulsewise with the lapse of time, is applied successively to the base of a transistor 11 which is a part of a drive circuit 20 for the internal combustion engine solenoid valve. Therefore, while the timer LSI 10 produces an L signal, the transistors 11 and 12 conduct.

Consequently, a solenoid valve lifting current and a solenoid valve holding current which are proportional to on-off time of the transistor 12 flow in the solenoid 13 of the solenoid valve for the internal combustion engine. A Zener diode 14 protects the transistor 12.

The timer LSI 10 stops producing the solenoid valve holding pulse signal when the number of pulses of signal reaches the preset number N. Thereafter, the timer LSI 10 produces a high level signal (H signal), so that the transistors 11 and 12 are turned off and the solenoid valve is closed.

Figure 3:
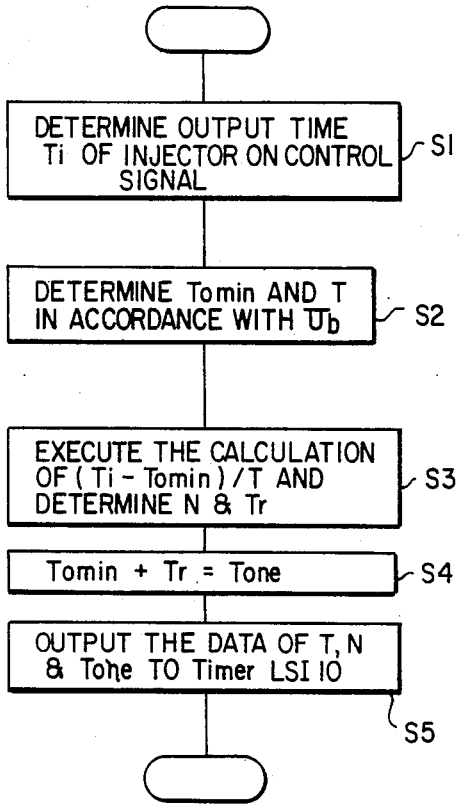
FIG. 3 is a flowchart showing operations of a microcomputer of the present invention.

FIG. 3 is a flowchart showing the operation of the microcomputer 1 in FIG. 2. The processing of FIG. 3 is executed, for example, at every generation of a top dead center (TDC) signal in each cylinder or at every rotation of the engine.

Step S1—As previously noted, the operating conditions of the engine are detected on the basis of input signals received from Ne sensor 5, Pba sensor 6, Tw sensor 7 and Pa sensor 8, and the output time Ti of the injector 0N control signal is determined by a suitable known method.

FIG. 4(*a*) shows an example of the thus-determined output time Ti of the injector ON control signal.

Step S2—The shortest time Tomin required for lifting the solenoid valve and the solenoid valve holding pulse period T are determined in accordance with an input signal received from a Vb sensor 30. More specifically, Tomin and T which are prestored in the memory 3 according to the characteristics of the solenoid valve and battery voltage Vb are selected and decided on the basis of the detected battery voltage Vb. This is for prolonging the ON time of the solenoid driving transistor 12 as the battery voltage Vb drops to thereby compensate for the reduction in the amount of current flowing through the solenoid 13. As to the solenoid valve holding pulse signal which is provided at the period T from the timer LSI 10, the H signal period does not change, while only the L signal period extends as the battery voltage Vb drops.

Step S3—The calculation $(Ti - Tomin)/T = N \ldots Tr$ is performed.

The above calculation determines the number N of solenoid valve holding pulses to be completely produced within the time (Ti - Tomin) as well as a remainder time Tr which is shorter than the pulse period T. FIG. 4(*b*) shows an example in which the said number N is five.

Step S4—The calculation $Tomin + Tr = Tone$ is performed. Tone is the finally determined actual solenoid valve lifting time as previously described.

Step S5—Data signals of T, N and Tone which have been determined in Steps S2, S3 and S4 are provided to the timer LSI 10.

As a result, as will be apparent from the foregoing explanation, a signal (injector ON control signal) of such a waveform as shown in FIG. 4(*c*) is provided from the timer LSI 10.

Thus in this embodiment, as is apparent from FIGS. 4(*a*) and 4(*c*), the end of the output time Ti of the injector ON control signal and the end of the last one period of the solenoid valve holding pulse signal provided from the timer LSI 10 are coincident with each other.

Consequently, in this embodiment the percent reduction in the current (solenoid current) of the solenoid 13 after the lapse of the output time of the injector 0N control signal is always constant, so the injector ON time can be set properly.

In other words, the injector ON time corresponds to a time $\alpha$ obtained by adding the output time Ti of the injector ON control signal, a time $\alpha$ required from the end of the time Ti until the solenoid valve is actually closed due to reduction of the solenoid current. But in the present invention, the $\alpha$ is always constant as previously noted, so if Ti is set in consideration of the $\alpha$ in advance, it becomes possible to set the injector ON time to a predetermined value.

Although in the above described embodiment the timer LSI 10 is used to generate the injector ON control signal [see FIG. 4(*c*)], the timer LSI 10 is not always needed. The injector ON control signal may be provided directly from the microcomputer 1.

Moreover, it is not always necessary that the shortest time Tomin required for lifting the solenoid valve and the solenoid valve holding pulse period T be varied in accordance with the battery voltage Vb. They may be constant values.

Figure 1:
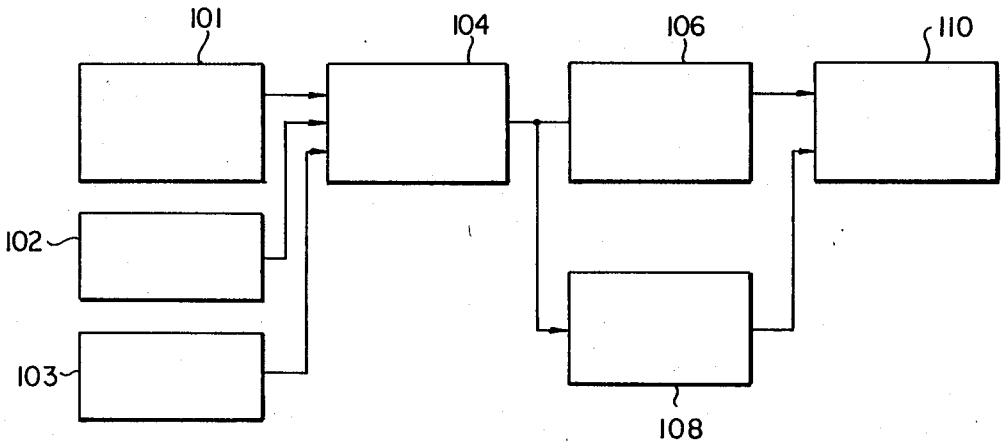
FIG. 1 is a functional block diagram showing the present invention.

The following description is now provided with regard to FIG. 1 which is a functional block diagram of the present invention.

A Ti determining means 101 detects engine operating conditions at a predetermined timing on the basis of data such as, engine speed, intake manifold pressure, engine temperature and atmospheric pressure, and determines an output time Ti of the injector ON control signal responsive to the engine operating conditions.

A T storage means 102 stores the period T of the solenoid valve holding pulse signal, and a Tomin storage means 103 stores the shortest time Tomin required for lifting the solenoid valve.

A calculating means 104 performs, for example, the calculation (Ti - Tomin)/T on the basis of the output time Ti of the injector ON control signal determined by the Ti determining means 101, the period T of the solenoid valve holding pulse signal stored in the T storage means 102 and the shortest time Tomin required for lifting the solenoid valve which time is stored in the Tomin storage means 103. The calculating means 104 then determines the number N of solenoid valve holding pulses to be completely produced within the time (Ti - Tomin) as well as a remainder time Tr. Further, the calculating means 104 adds the remainder time Tr to the Tomin stored in the Tomin storage means 103 and calculates an actual solenoid valve lifting time Tone.

A solenoid valve lifting signal generating means 106 generates and outputs a solenoid valve lifting signal corresponding to the Tone.

A solenoid valve holding pulse generating means 108 generates and outputs a solenoid valve holding pulse signal according to the period T fed from the calculating means 104 and the number N calculated by the calculating means 104 so that the solenoid valve holding pulse signal follows the solenoid valve lifting signal.

A solenoid valve drive circuit 110 is controlled by the solenoid valve lifting signal and the solenoid valve holding pulse signal to adjust the current flowing through the solenoid (FIG. 2).

Figure 6:
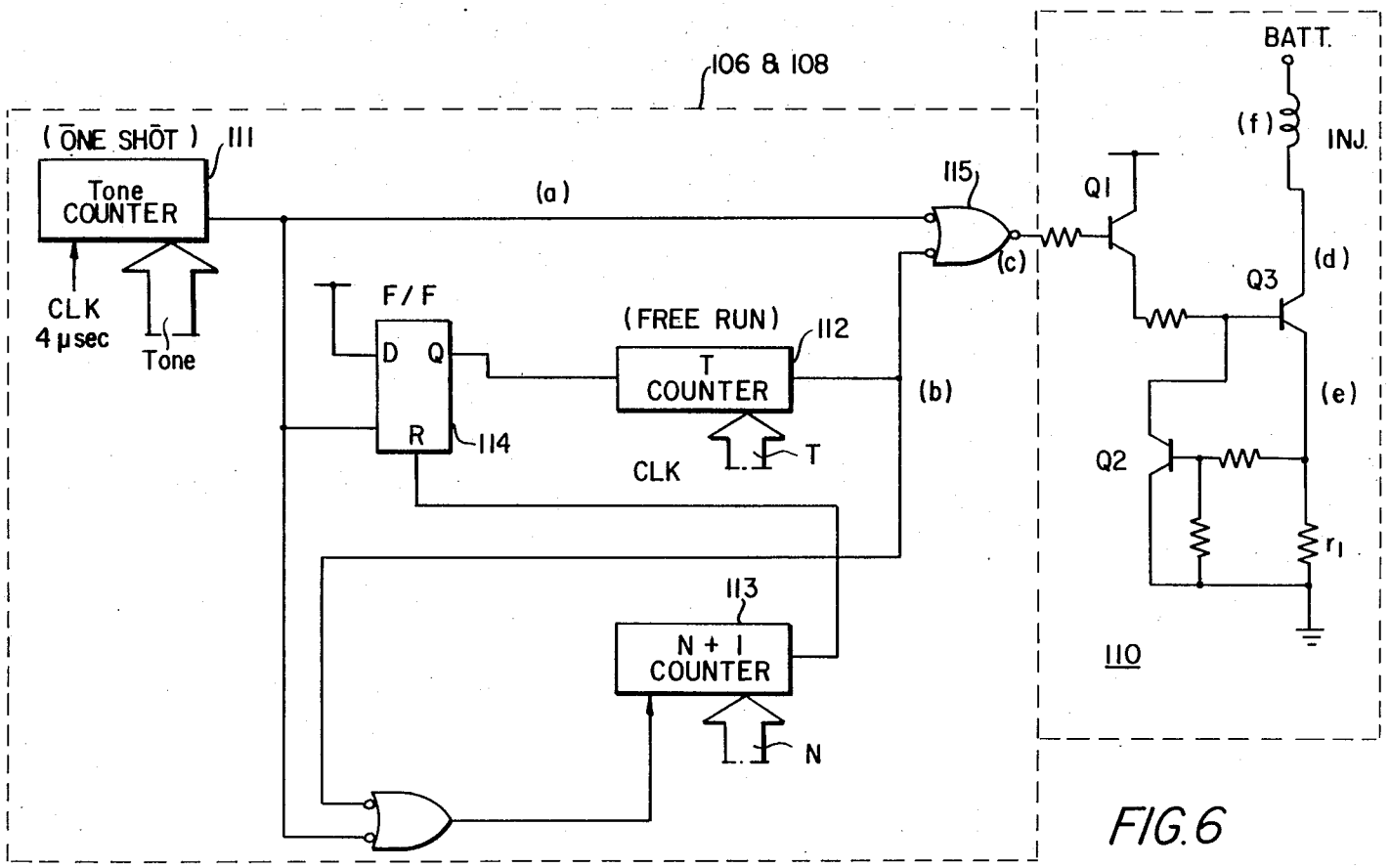
FIG. 6 is a schematic circuit diagram of an embodiment of the lift signal generator, hold pulse generator, and solenoid drive circuit of the present invention.
Figures 7A, 7B, 7C, 7D, 7E, 7F:
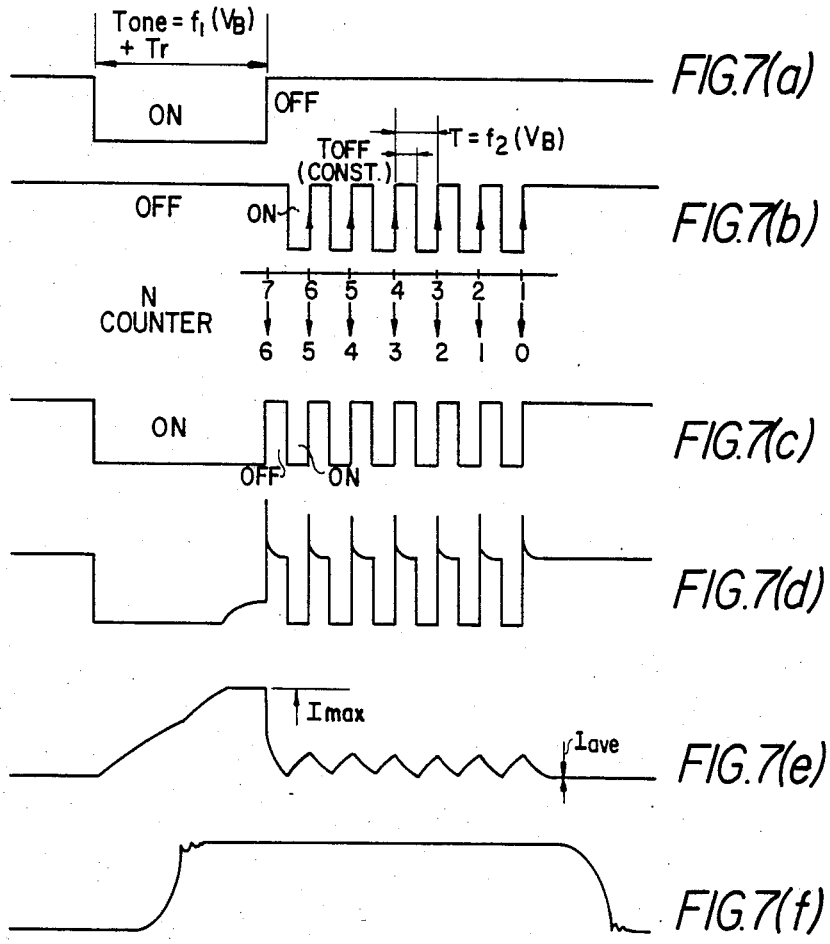
FIG. 7 is a time chart for explaining the operation of the circuit of FIG. 6.

FIG. 6 is a circuit diagram of a circuit for performing the operation of the lift signal generator 106 and hold pulse generator 108, and solenoid drive circuit 110. FIG. 7 is a timing chart illustrating the operation of the circuit in FIG. 6.

The values of Tone, T, and N are calculated by calculating circuit 104 and these values are applied respectively to Tone counter 111, T counter 112, and N+1 counter 113. As shown in FIG. *7a*, Tone counter 111 starts counting and produces a negative going edge. When the period Tone has been counted, counter 111 produces a rising edge which sets flip-flop 114. When flip-flop 114 is set, output Q rises thereby starting the operation of T counter 112 which is a free running multi-vibrator. The outputs of Tone counter 111 and T counter 112 are applied to NOR gate 115, the output of which is applied to the drive circuit 110. The output of T counter 112 is also applied to N+1 counter 113, which counts the rising edges of the output of T counter 112, as shown in FIG. *7(b)*. When the N+1 counter 113 counts to a value of N+1, it produces an output which is applied to the reset input of flip-flop 114 thereby switching the flip-flop and causing the output Q to switch to a low level. This results in the stopping of the T counter 112. A signal C shown in FIG. *7(c)*, which is a combination of the signals A and B shown in FIGS. *7(a)* and *(b)* respectively, are applied to the injector drive circuit 110.

The present invention may be embodied in other specific forms without departing from the spirit or essential characteristics thereof. The presently disclosed embodiments are therefore to be considered in all respects as illustrative and not restrictive, the scope of the invention being indicated by the appended claims, rather than the foregoing description, and all changes which come within the meaning and range of equivalency of the claims are, therefore, to be embraced therein.

I claim:

1. A system for driving a solenoid valve for an internal combustion engine, comprising:

(a) a Ti determining means for detecting the operating state of the engine at a predetermined time and determining an output time Ti of an injector ON control signal in accordance with the operating state of the engine;

(b) a T storage means for storing a period T of a solenoid valve holding pulse signal;

(c) a Tomin storage means for storing a shortest time Tomin required for lifting the solenoid valve;

(d) a calculating means coupled to said Ti determining means, said T storage means, and said Tomin storage means, for calculating a solenoid valve holding time which is equal to or shorter than the difference obtained by subtracting Tomin from Ti and which is an integer (N) multiple of T, and calculating an actual solenoid valve lifting time Tone from a difference between said Ti and said solenoid valve holding time;

(e) a solenoid valve lifting signal generating means coupled to said calculating means, for generating a solenoid valve lifting signal in accordance with Tone;

(f) a solenoid valve holding pulse generating means coupled to said calculating means, for generating N number of solenoid valve holding pulse signals at a predetermined duty ratio and at the period T in accordance with T and N; and (g) a solenoid valve drive circuit coupled to said lifting signal generating means and said holding pulse generating means and controlled in accordance with said solenoid valve lifting signal and solenoid valve holding pulse signal.

2. A system for driving a solenoid valve for an internal combustion engine as set forth in claim 1, wherein said solenoid valve lifting time Tone is obtained by calculating a remainder time Tr from (Ti - Tomin)/T and adding the remainder time Tr to Tomin.

3. A system for driving a solenoid valve for an internal combustion engine as set forth in claims 1 or 2, wherein the shortest time Tomin required for lifting the solenoid valve varies according to voltage supplied to the solenoid valve.

4. A system for driving a solenoid valve for an internal combustion engine as set forth in claims 1 or 2, wherein the period T of the solenoid valve holding pulse signal varies according to voltage supplied to the solenoid valve.

5. A system for driving a solenoid valve for an internal combustion engine, said system comprising:

(a) sensor means for sensing a plurality of engine conditions;

(b) microprocessor means coupled to said sensor means, said microprocessor means calculating an injector ON time consisting of a solenoid lift time signal and a solenoid hold time signal, wherein the solenoid hold time signal consists of an integral number of identical holding pulses;

(c) timer means coupled to said microprocessor means; and (d) solenoid drive circuit means coupled to said timer means for driving the solenoid of said solenoid valve, wherein said timer means provides control signals to said drive circuit means in accordance with the lift time signal and hold time signal.

6. A system as set forth in claim 5, wherein said sensor means comprises:

(a) an engine speed sensor;

(b) an intake manifold pressure sensor;

(c) an engine temperature sensor; and (d) an atmospheric pressure sensor.

7. A system as set forth in either of claims 5 or 6, wherein said sensor means includes battery voltage sensor means for sensing the battery voltage applied to said solenoid.

8. A system for driving a solenoid valve of a fuel injector for an internal combustion engine comprising:

(a) a Ti determining means for detecting the operating state of the engine at a predetermined time and determining an output time Ti of an injector ON control signal in accordance with the operating state of the engine;

(b) lifting pulse generating means for generating a pulse having a predetermined period for lifting the solenoid valve;

(c) holding pulse train generating means for generating a plurality of pulses for holding the solenoid valve in the lifted state; and (d) termination timing adjusting means for adjusting termination timing of holding pulse train such that there is coincidence between the end of the period Ti and the end of a holding pulse.

9. A system for driving a solenoid valve as set forth in claim 8, wherein said holding pulse train generating means generates an integral number of pulses having equal pulse width.

10. A system for driving a solenoid valve as set forth in claim 9, wherein the predetermined period of the lifting pulse is equal to the difference between the period Ti and the period of the holding pulse train.

* * * * *